US006461152B2

(12) United States Patent
Wood et al.

(10) Patent No.: US 6,461,152 B2
(45) Date of Patent: Oct. 8, 2002

(54) TUBULAR BURNER

(75) Inventors: Graham Wood, Leeds (GB); Edward Hart, Leeds (GB)

(73) Assignee: Bray Burners Ltd., Leeds (GB)

( * ) Notice: Subject to any disclaimer, the term of this patent is extended or adjusted under 35 U.S.C. 154(b) by 0 days.

(21) Appl. No.: 09/682,818

(22) Filed: Oct. 22, 2001

(65) Prior Publication Data

US 2002/0055079 A1 May 9, 2002

(51) Int. Cl.[7] ..... F23D 14/62; F23D 14/12
(52) U.S. Cl. ..... 431/354; 431/326; 431/328
(58) Field of Search ..... 431/326, 328, 431/354, 329, 350; 126/39 R, 92 R, 91, 92 AC; 239/553.3

(56) References Cited

U.S. PATENT DOCUMENTS

| | | | | | |
|---|---|---|---|---|---|
| 1,507,791 A | * | 9/1924 | Packer | ..... | 431/354 |
| 3,156,292 A | * | 11/1964 | Ross | ..... | 239/553.3 |
| 4,140,100 A | * | 2/1979 | Ishihara | ..... | 431/328 |
| 4,396,372 A | * | 8/1983 | Matumoto et al. | ..... | 431/354 |
| 4,976,609 A | * | 12/1990 | Grob | ..... | 431/328 |
| 5,743,727 A | * | 4/1998 | Rodgers | ..... | 431/328 |

* cited by examiner

*Primary Examiner*—James C. Yeung
(74) *Attorney, Agent, or Firm*—Ronald E. Smith; Smith & Hopen, P.A.

(57) ABSTRACT

The invention describes a tubular burner consisting of a cylindrical tubular body initially open at either end into which a distributor component can be slidingly fitted. The tubular body is provided with rows of apertures over a narrow area of the uppermost surface thereof to give the burner a flame strip. The distributor is substantially the same axial length as the tubular burner body but of smaller cross-sectional dimension than said body allowing for sliding fitment of the distributor inside the burner body. In accordance with the invention, the distributor has a first tubular portion and a second extension portion which is effectively a continuation of the upper surface of said first tubular portion, and both the tubular portion and extension portion of the distributor are provided with axially aligned flanges on either aide having a number of perforations. As the distributor is slid axially along the tubular burner body, the edges of the flanges engage with the inner walls of the tubular burner body and thus divide the burner body into an upper and lower chamber, the combustible air/gas mixture emerging from the tubular portion of the distributor into the lower chamber and subsequently being urged upwardly through the apertures in said flanges into the upper chamber before passing through the flame ports for combustion on the upper surface of said tubular body. The invention also relates to a distributor for use in such a burner.

9 Claims, 5 Drawing Sheets

TUBULAR BURNER

BACKGROUND OF INVENTION

This invention relates to a tubular burner, and more specifically to a tubular hollow burner of desired cross-section being axially long compared to the dimensions of the cross-section. The invention also relates to a distributor disposed internally of the hollow burner which ensures good mixing of the gas and air in the combustible fluid urged through the burner and as near to an even flame profile as possible on the flame strip of said burner.

Although the following description related almost exclusively to fully pre-mixed cylindrical tubular burners, it is to be mentioned that the burner of the present invention may be used for non pre-mixed and normally aspirated applications and furthermore the cross-sectional shape of the burner is unimportant The invention should accordingly not be considered as limited by the following description. It should also be mentioned that the word tubular as used herein describing burners is to be taken to mean any burner having an outer surface which defines an internal cavity in which distribution means can be disposed.

Pre-mixed burners are so-called because the fuel, usually gas (under denominations for reference gases and test gases identified in European Standard EN 297), and a fan supplied quantity of air exceeding the stoichiometrically correct amount of air for the specific gas type (superstoichiometric) are mixed to produce a combustible mixture which subsequently is passed through the burner and ignited to produce a burner flame that, in the case of heating the water in a boiler, is applied to a heat exchanger of the boiler. The term pre-mixed arises therefore because of the mixing of the fuel and air before the combustible mixture passes through the flame strip.

There are other types of burners which operate in a mode in which a sub-stoichiometric amount of primary combustion air is mixed with the fuel before the flame strip, secondary air required for completing the combustion process being induced into the flame after ignition of the gas/primary air mixture. These other burners are known as partially pre-mixed burners. The present invention may be applicable to such burners, but its best application is to the fully pre-mixed type, as partially premixed burners are limited by the relatively high levels of nitrogen oxides (NOx) they generate during the combustion process and as such, these burners are diminishing in popularity.

Fully pre-mixed burners tend to be high intensity burners in which high volumes of gas/air mixture are forced through a relatively small area (in plan) burner, and specifically through the ports in the flame strip to give a compact, high intensity flame which sits on or near the surface of said flame strip.

The high volume of the gas/air flow being urged through the small port area of the burner flame strip means there is provided a high "port-loading" on each individual burner port. The fact that a compressible mixture flows through the burner at a certain velocity means that any instabilities created on ignition of said mixture are amplified and can ultimately develop a common frequency which constructively harmonizes with the natural frequency of the boiler system to generate a phenomenon called combustion resonance which is manifested in noise. Noise of any audible volume or frequency is unacceptable for pre-mixed burner applications.

The boiler system comprises the combustion chamber, the heat exchanger which will occupy a predetermined position within said combustion chamber, and a flue attached to said chamber to vent the exhaust gases of combustion. Any variance of these parameters will influence the harmonics of the system e.g. varying the flue length will change the back pressure on the combustion chamber.

The combustion resonance is manifested as three distinct types of resonance:

1. A low frequency (125 to 200 Hz) rumble on ignition; This is believed to be due to flame instabilities caused by poor gas/air mixing, bad gas/air mixture distribution and poorly timed ignition, such being associated with the burner appliance design factors of upstream mixing of gas and air, position of igniter etc.

2. A higher frequency (250 to 315 Hz) resonance on ignition at volumes up to 95 dB; Under standard repeat ignition conditions the flame ignites and thermally fluctuates initially as it stabilizes near the port. The differential pressures and temperatures created initially in the system exacerbate this instability creating a range of oscillating and fluctuating frequencies of flame vibration, some of which may harmonize and thus be amplified at one or more of the natural resonance frequencies bands of the system. However, once the system has been operational for approximately a minute, these instabilities dissipate and the resonance fades out.

3. A continuous high frequency resonance can develop once the flames have stabilized. This can arise from instabilities caused by ignition resonance and which are continuously excited by virtue of the gas/air flow movements within the system during operation, or by the inherent excitations developed by virtue of the burner design.

Currently, conventional metal burners of the type considered herein having ports integrally formed on an outer surface thereof cannot offer the "turndown" range (the range over which the flame is stable on or proximate the surface of the burner as the gas/air flow is gradually reduced) demanded by manufacturers of modern appliances, and therefore ceramic materials are often used in such applications. Additionally, the risk of "flashback" at low port loadings where the flame burns on or very close to the flame strip must be eliminated and this has heretofore proved difficult.

At much higher port loadings, the flame can lift away from the flame strip as a result of the increased and rapid volumetric throughput of gas through the ports, and flame instabilities can thus result.

The stability of the flame on the burner flame strip is dependent on the open area of said flame strip (port area per unit area of the flame strip), the surface area "land" surrounding each port, i.e. the length of the ports, the pattern of ports, the profile of the flame strip surface, and the efficacy of any distribution means disposed behind the flame strip internally of the burner. A stable flame requires sufficient "land" to anchor itself thermally to the port, but this requirement compromises the total open area of the plaque and hence increases the port loading, with the attendant disadvantages of lift-off mentioned above. There is therefore a trade off between these two parameters.

A further consideration in modern burner design is the recently introduced requirements for reducing emissions of noxious gases such as NOx (Nitrogen Oxide) and CO (Carbon Monoxide) below predetermined limits.

U.S. Pat. No. 5,743,727 to Rodgers describes a burner of similar construction to that with which the invention is concerned. Specifically, a cylindrical tubular burner is described having an outer cylindrical tube body with a blind or capped end and a plurality of perforations provided over a small sector of the body along the length of said tube. This perforated sector forms the flame strip of the burner and internal distribution of the combustible gas mixture underneath the flame strip to obtain an even flame profile thereon is achieved by means of an elongate distributor of similar cross-sectional shape but of smaller size so that the distributor can be slid within the body and sealed to the blind end or cap thereof.

Injection means is provided at the open end of the distributor and air may be drawn thereinto along with the gas so that a combustible mixture (which may at that stage not be evenly or thoroughly mixed) passes through the hollow distributor. In accordance with the invention of the U.S. patent, a plurality of outlets are provided on the underside of the distributor approximately 180° from the sector over which the perforations on the burner body are provided so that the combustible gas is mixed thoroughly with air before being urged through said perforations. Furthermore, the distributor outlets are preferably disposed only towards the end of the distributor which is sealingly affixed to said body blind end or cap so that some initial mixing of the combustible gas and air occurs in the front end of the distributor before these gases pass through the outlets and flow circumferentially around the outer surface of the distributor upwardly within the body and ultimately through the perforations in the upper sector of said body.

The effective distribution of the combustible gas/air mixture is achieved by disposing the outlets towards the far end of the distributor proximate the blind end of the body and providing louvers on the outlets internally of the distributor so that the gaseous mixture emerging from said outlets not only travels circumferentially around the distributor towards the flame strip but also in a reverse direction to that in which the mixture travels within the distributor. The result is a reasonably even gas pressure behind the entire flame strip and thus a substantially uniform flame profile.

Although this type of burner configuration achieves reasonable distribution of combustible gas mixture behind the flame strip and thus a generally even flame profile is achieved on the burner flamestrip, the construction and assembly of the burner is expensive, as is the manufacture of the various components involved in said construction.

Additionally this burner suffers from a high static pressure within the distributor tube and additionally immediately behind the flame strip. As a result of this high pressure, the gas mixture and flame distribution is difficult to control and this can compromise the resulting flame profile.

It is an object of this invention to provide a tubular burner having a wide operating range and being efficient from the point of view of substantially reducing noxious gas emissions which is nevertheless simple and Inexpensive to manufacture, construct and assemble.

It is a further object of this invention to provide a burner which provides a good distribution and an even pressure of combustible gas mixture behind the burner flame strip so that a uniform flame profile is obtained on the surface thereof.

It is a yet further object of this invention to provide a burner which provides a solution to the problems associated with the high static pressures developed inside the distribution tube and the hollow burner body.

SUMMARY OF INVENTION

According to the invention there is provided a tubular burner comprising a tubular body of desired cross sectional shape and being axially long in comparison to the dimensions of said cross-section, said body having an outer surface over an axially aligned portion of which is provided a plurality of perforations which portion constitutes the flame strip of said burner immediately beneath which an upper region of the burner is partially defined internally of said tubular body, said burner further comprising an elongate distributor of substantially the same axial length as the tubular burner body and being of smaller cross-sectional dimension than said body allowing for sliding fitment of said distributor therein, said distributor having a first tubular portion opening proximate an open end of said burner body into which combustible fluid can be introduced, said tubular portion having an upper surface which together with the flame strip defines the upper region of said tubular body, and a second extension portion which is effectively a continuation of the upper surface of said tubular portion and thus also defines the upper region of said body and constrains fluid emerging from the tubular portion to flow therebeneath, characterized in that both tubular portion and extension portion of the distributor are provided with axially-aligned flanges having a predetermined number and distribution of perforations therein, said flanges contacting the inner wails of the burner body to effectively divide the inside of the burner body into an upper chamber behind the flame strip and a lower chamber into which combustible fluid is urged from the tubular portion of said distributor, said fluid passing from the lower chamber into the upper chamber through said perforations and being evenly distributed in said upper chamber by virtue of the number and distribution of said perforations along the length of said distributor.

Most preferably the cross sections of the tubular body and distributor are circular.

Further preferably flanges are provided on diametrically opposite sides of said distributor tubular portion and extension portion or on opposed sides thereof when the cross-section is not circular.

Preferably the tubular burner body is open at either end and the distributor is provided with a cap secured to the free end of said extension portion, said cap having dimensions corresponding to the dimensions of the tubular body to allow for both sliding fitment of said distributor within said body and sealing attachment of said cap to one of said open ends of said body.

Most preferably the distributor consists of a cap portion to which is welded a hemi-cylindrical elongate section having a longitudinal axis substantially coincident with the longitudinal axis of the burner body, said section being orientated so that its zenith is directly beneath an axially parallel line bisecting the flame strip, and a tubular portion secured within the hemi-cylindrical section having a first end coincident with a free end of the hemi-cylindrical section and a second end opening part way along said hemi-cylindrical section.

Preferably the hemi-cylindrical section is welded to the cap and the cap ultimately welded or otherwise secured to said burner body.

The effective division of the burner body by the flanges and the upper hemi-cylindrical section of the distributor into two discreet chambers, one being a mixing chamber and the other being a gas delivery chamber, has a number of advantages.

Firstly, the flanges of the distributor serve as guides therefore during insertion into the burner body.

Secondly, the number and distribution of the perforations in the flanges can be easily altered allowing for simple testing and re-design of the distributor to suit particular circumstances. The perforations also serve as an extremely effective and simple means of distributing the combustible fluid mixture beneath the flame strip.

Thirdly, greater flexibility of air delivery can be achieved, thus imparting a greater degree of control on static pressures depending on the number and disposition of said perforations along the length of the flanges.

Additionally, a greater degree of flexibility can be achieved for mixing of multiple gases.

Fourthly, the distributor offers a common footprint for each burner diameter.

BRIEF DESCRIPTION OF DRAWINGS

A specific embodiment of the invention will facilitate the understanding of the invention and is now provided by way of example with reference to the accompanying drawings wherein.

DETAILED DESCRIPTION

Figure 1:
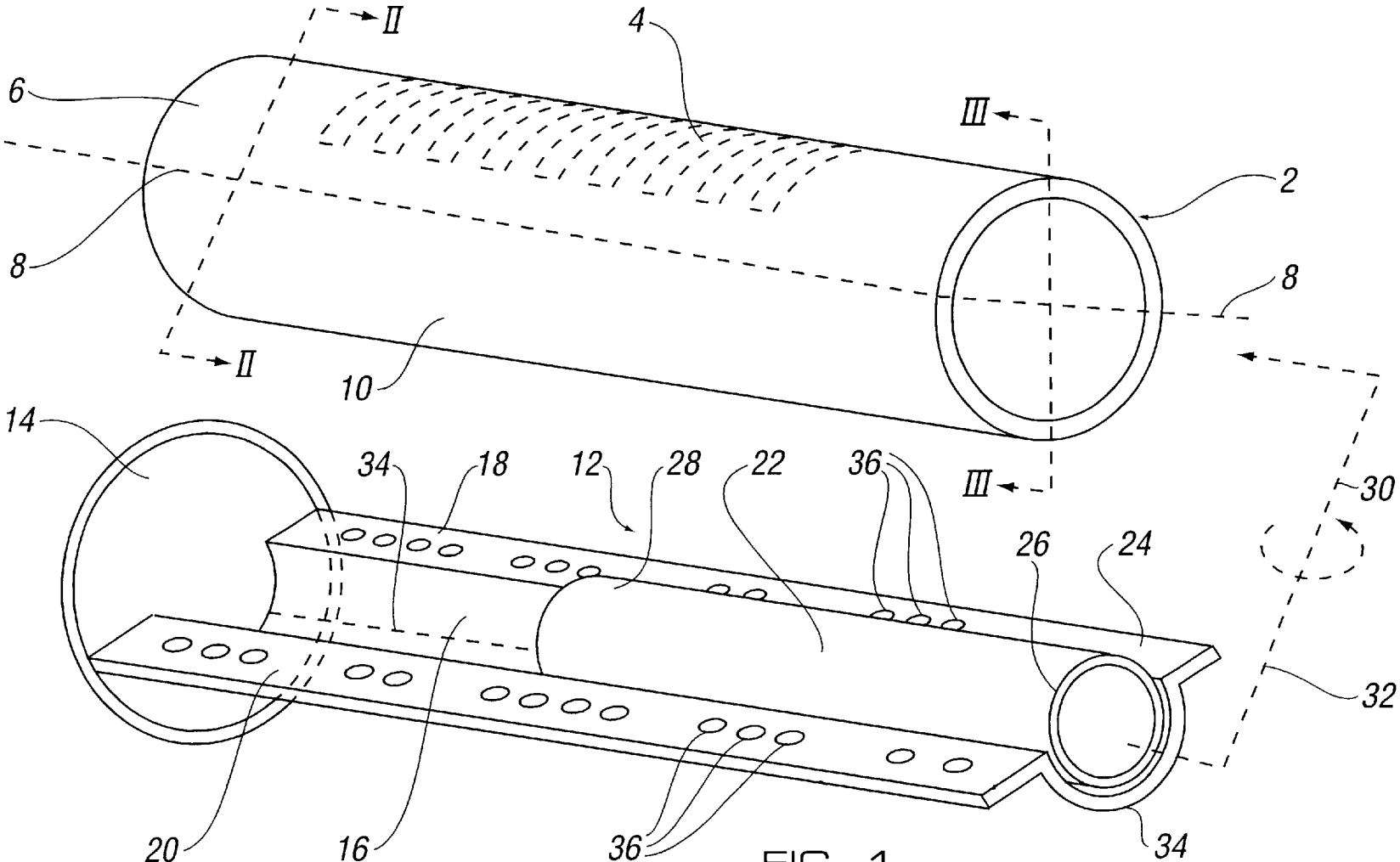
FIG. 1 shows a perspective view of the burner body and distributor insert.

Referring firstly to FIG. 1, there is shown a burner body 2 having a circular cross-section and being hollow over its entire length and further being provided with a plurality of perforations 4 over a narrow sector of its upper surface. Burner body 2 can be divided into an upper region 6 and a lower region 10 by an imaginary line 8 bisecting the cylindrical body, and this notion of upper and lower regions will be useful in explaining the invention below. Also shown in FIG. 1 is an elongate distributor 12 having an end cap 14 to which is brazed a hemi-cylindrical elongate section 16 of substantively the same axial dimension as the burner body 10 having a pair of flanges 18, 20 disposed on either side of the hemi-cylindrical portion of the section. It is to be appreciated that the perspective view shown in FIG. 1 of the distributor is of the underside thereof, and a hollow cylindrical imperforate tubular member 22 is ideally welded within the hemi-cylindrical section towards a free end 24 thereof so that a first open end 26 of the imperforate tubular member is substantially adjacent the free end 24 of said hemi-cylindrical section. Said imperforate tubular member 22 in use forms part of the mixing chamber of the burner and it is through this imperforate tubular member that a combustible fluid mixture flows before emerging into the lower region 10 of the burner body through the second opening 28 of said imperforate tubular member.

The arrows 30, 32 indicate how the distributor 12 is inserted into the burner body so that the zenith 34 of the hemi-cylindrical section 16 is immediately beneath an imaginary axial line bisecting the sector of perforations in the burner body 2.

It will also be seen from FIG. 1 that the flanges 18, 20 are provided with a plurality of apertures 36, optionally of different diameters, spacings, and number to provide an effective means of distribution of combustible fluid mixture beneath the perforations 4 in the burner body. The sector of perforations 4 in the burner body will be hereinafter referred to as the flame strip.

Figure 2:
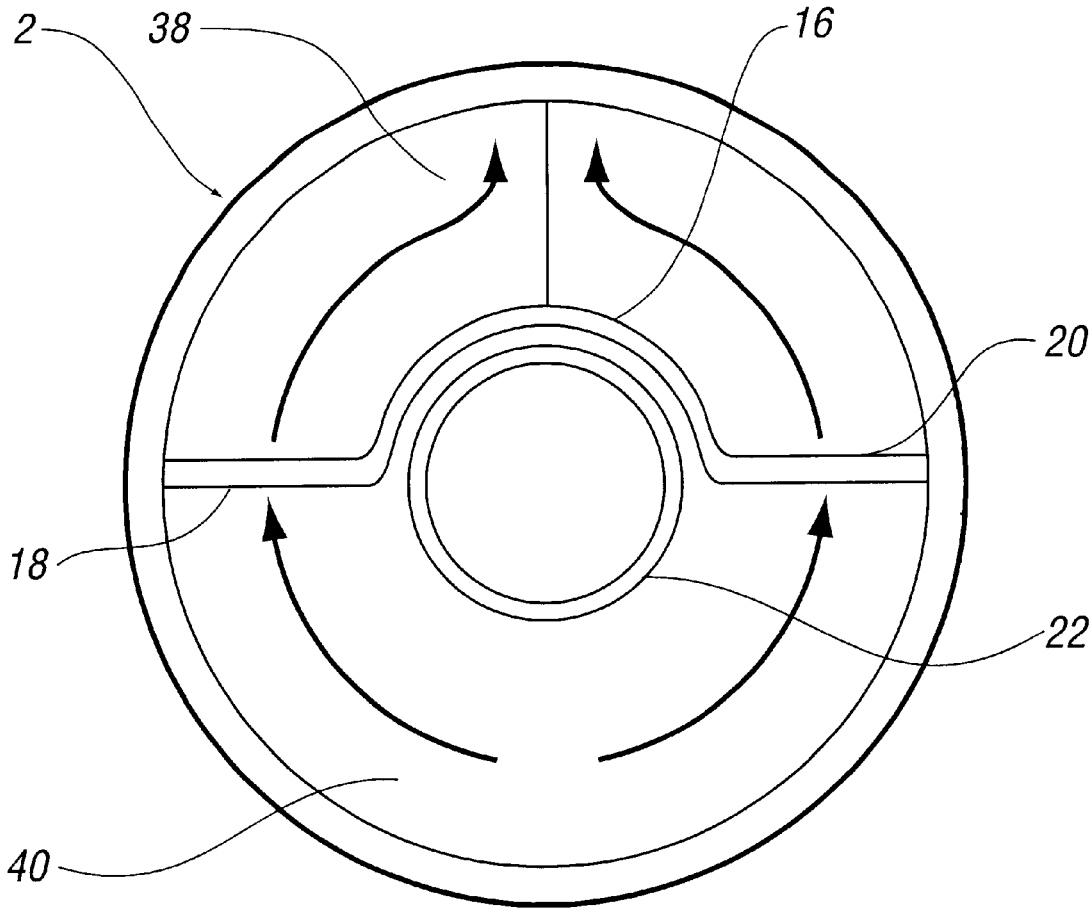
FIG. 2 shows an end elevation of the burner body having the distributor insert located therein.

It can be seen from FIG. 2 how burner body 2 is divided into two separate and discrete chambers 38, 40 by the insertion of the distribute because the edges of flanges 18, 20 abut the inner walls of burner body 2, and hemi-cylindrical section 16, together with imperforate tubular member 22 effectively prevent any gas flow from lower chamber 40 through to upper chamber 38 except through perforations 36.

Figure 3:
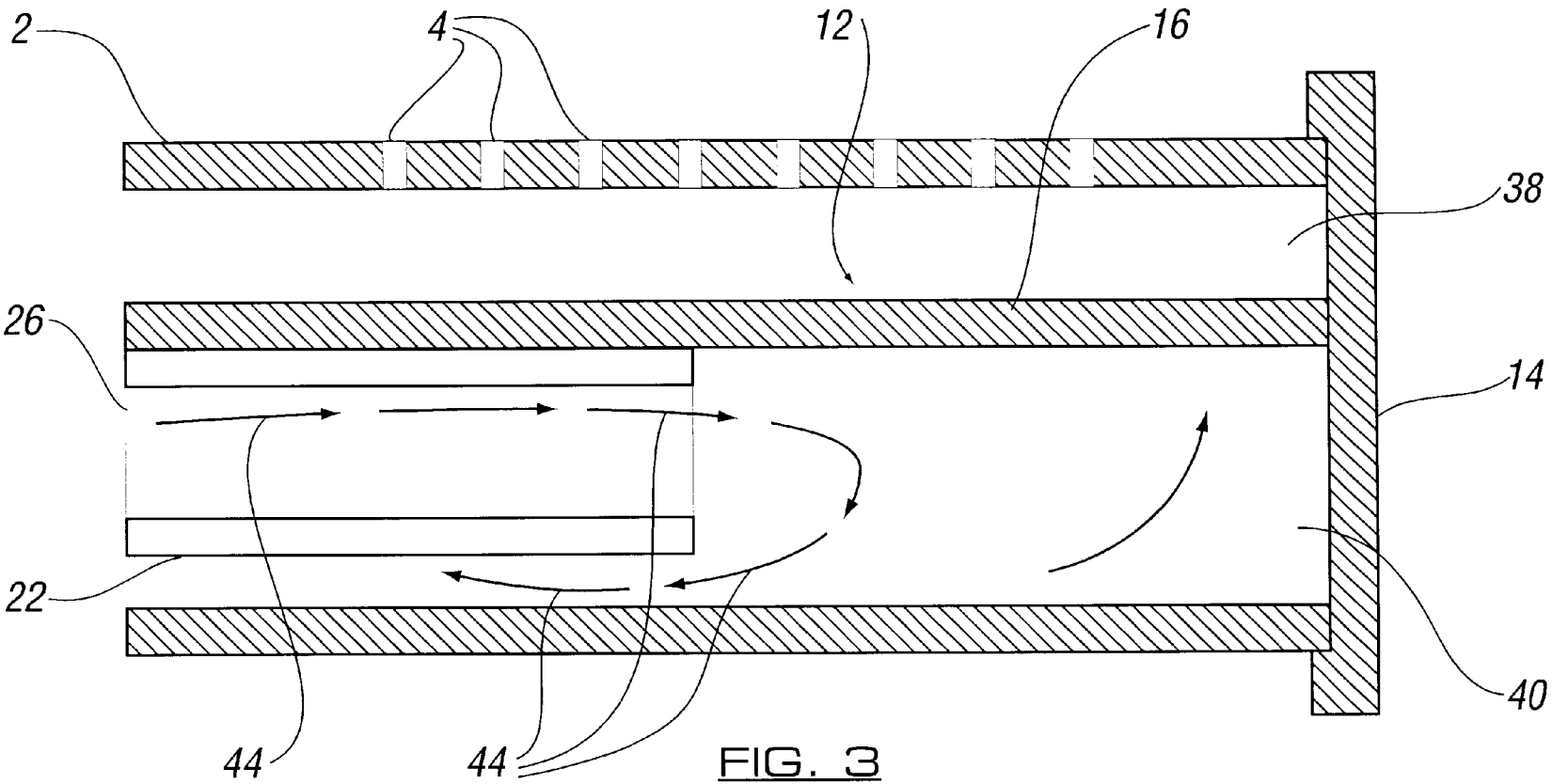
FIG. 3 shows a sectional view through the burner body having the distributor insert located therein.
Figure 4:
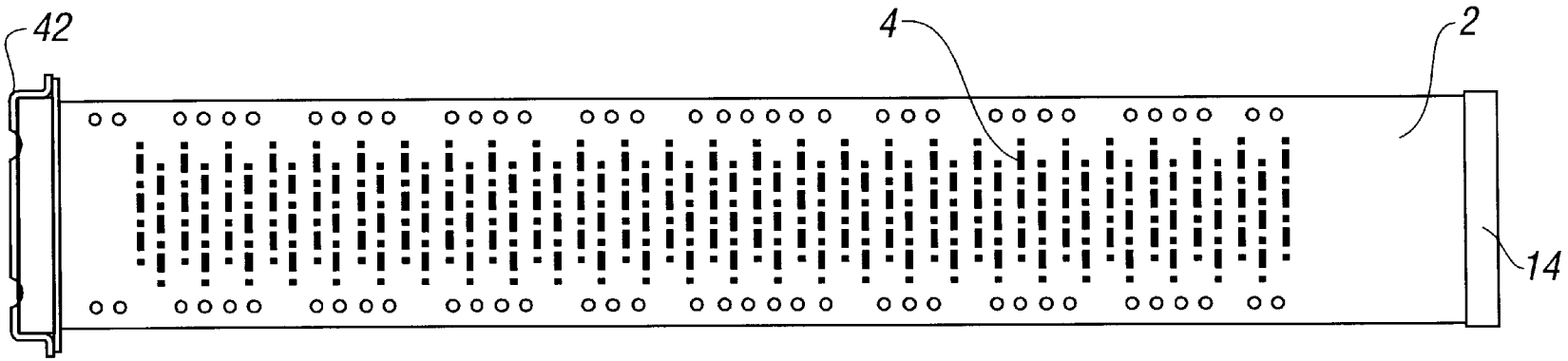
FIG. 4 shows a plan view of the burner body from above.
Figure 5:
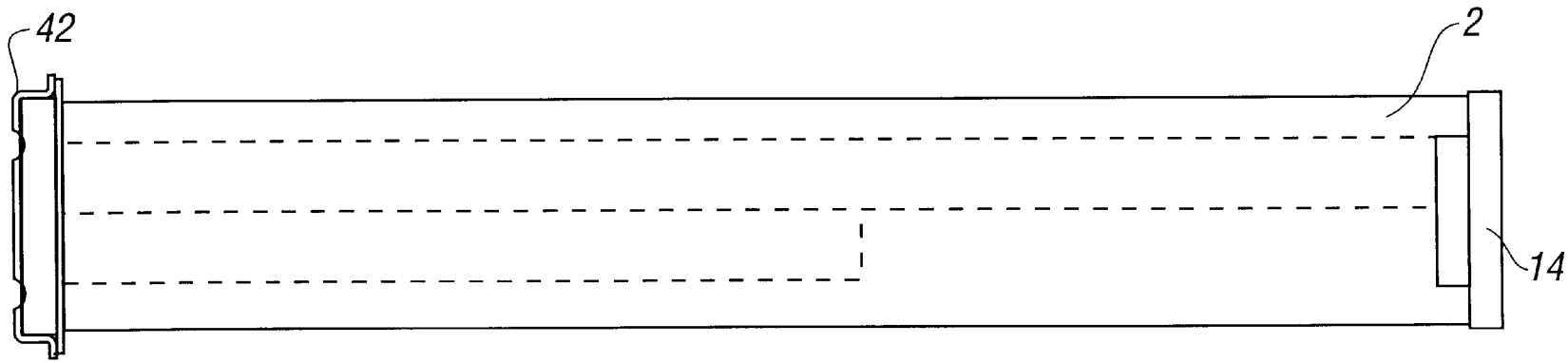
FIG. 5 shows a side elevation of the burner body with the distributor located therein shown in dotted lines.
Figure 6:
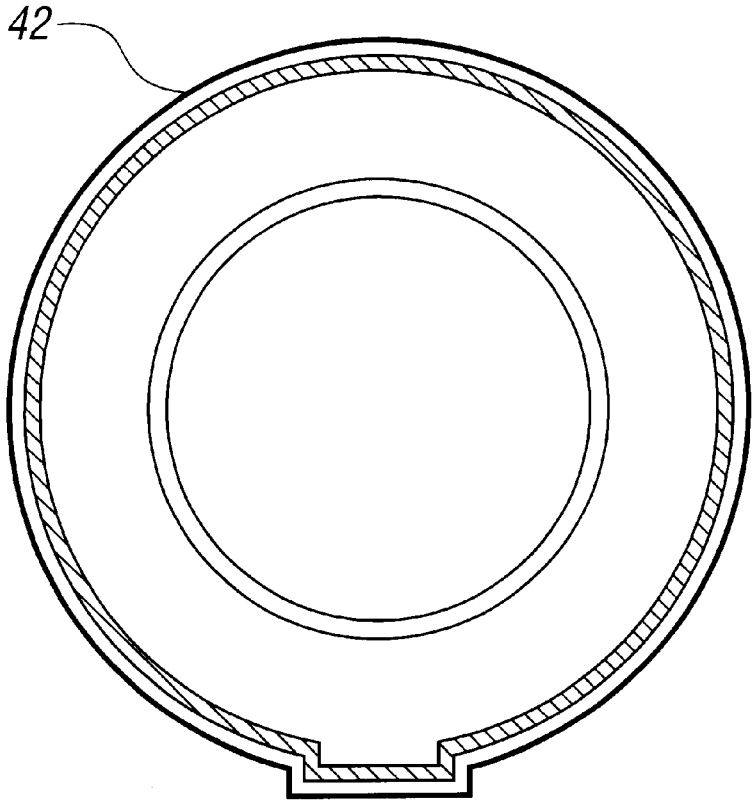
FIG. 6 shows an end elevation of the burner having a closure cap fitted over the open end thereof.

In FIG. 3, a sectional view is shown of the burner body 2 having the distributor 12 located therein so that only one end of the burner body 2 remains open. It will be seen from the figure that the end 26 of the tubular section 22 is substantially coplanar with the corresponding end of the burner body 2, and it is to this open end of the burner that a closure cap, optionally being provided with gas injector means, is fixed as shown at 42 in FIGS. 4, 5 and 6. Preferably, said closure cap 42 is welded to both the edges of the open end of the burner body 2, and the edges of the tubular section and hemi-cylindrical section so as to effectively seal one chamber 38 from the other chamber 40 and constrain any Injected combustible fluid to flow firstly through the tubular section 22 as indicated in FIG. 3 by arrows 44 and thence into the chamber 40 from where the gas can circumferentially flow around the inner walls of the body 2 through the perforations 36 to be distributed thereby underneath the flame strip.

Figure 7:
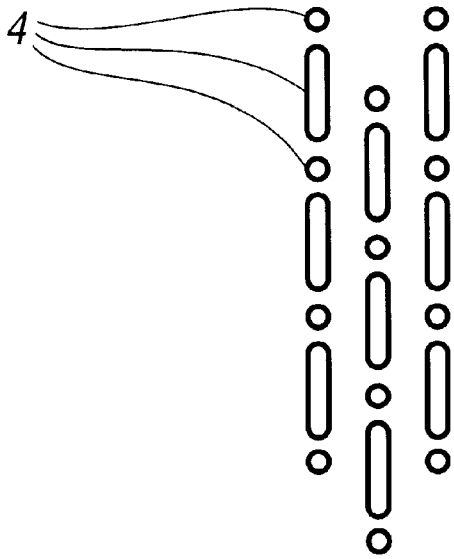
FIG. 7 shows a possible arrangement of the perforations in the upper surface of the burner body.

Finally, in FIG. 7, the arrangement and shape of perforations 4 provided in the upper surface of the burner body 2 is shown. It would be appreciated by the skilled person however that this arrangement is only one of a number of possible arrangements, and that these perforations and their shape may be chosen so as to satisfy particular burner application criteria.

In summary therefore, the invention describes a tubular burner consisting of a cylindrical tubular body initially open at either end into which a distributor component can be slidingly fitted. The tubular body is provided with rows of apertures over a narrow area of the uppermost surface thereof to give the burner a flame strip. The distributor is substantially the same axial length as the tubular burner body but of smaller cross-sectional dimension than said body allowing for sliding fitment of the distributor inside the burner body. In accordance with the invention, the distributor has a first imperforate tubular member and a second extension portion which is effectively a continuation of the upper surface of said first imperforate tubular member, and both the imperforate tubular member and the extension portion of the distributor are effectively provided with axially aligned flanges on either side having a number of perforations. As the distributor is slid axially along the tubular burner body, the edges of the flanges engage with the inner walls of the tubular burner body and thus divide the burner body into a upper and lower chamber, the combustible air/gas mixture from the imperforate tubular member of the distributor into the lower chamber and subsequently being urged upwardly through the apertures in said flanges into the upper chambers before passing through the flame ports for combustion on the upper surface of said tubular body. The invention also relates to a distributor for use in such a burner.

What is claimed is:

1. A tubular burner, comprising:

a tubular body having a predetermined longitudinal extent that exceeds a transverse cross sectional dimension of said tubular body;

a plurality of perforations formed in said tubular body in longitudinally spaced apart relation to one another, said plurality of perforations collectively forming a flame strip;

an elongate distributor of substantially the same longitudinal extent as the tubular body and having a smaller cross-sectional dimension than said tubular body;

said elongate distributor being slideably disposed within a hollow interior of said tubular body;

said elongate distributor having a first open end proximate a first open end of said tubular body, said first open end of said tubular body adapted to receive a combustible fluid;

said elongate distributor including an imperforate tubular member and an extension member;

said extension member having a length substantially the same as the longitudinal extent of said tubular body;

said imperforate tubular member having a length less than the longitudinal extent of said tubular body;

a pair of flanges formed integrally with said extension member and extending radially therefrom so that respective outermost ends of said flanges sealingly engage interior side walls of said tubular body along the entire longitudinal extent of said tubular body;

said flanges contacting the inner walls of the tubular body to divide the aside of the tubular body into an upper region immediately underneath the flame strip and a lower region into which combustible fluid flows from the imperforate tubular member of said elongate distributor, said combustible fluid passing from the lower region into the upper region through said perforations.

2. The tubular burner according to claim 1 wherein the respective transverse cross sections of the imperforate tubular member and elongate distributor are predominantly arcuate.

3. The tubular burner according to claim 2 wherein the transverse cross section of the tubular body is circular and the transverse cross section of the imperforate tubular member is circular, and the transverse cross section of a main body of the extension member is hemi-cylindrical.

4. The tubular burner according to claim 1 wherein the flanges are formed on opposite sides of said extension member.

5. The tubular burner according to claim 4 wherein the flanges are co-planar.

6. The tubular burner according to claim 1 wherein the tubular body is open at either end and the elongate distributor is provided with a cap secured to the free end of said extension member, said cap having dimensions corresponding to the dimensions of the tubular body to allow for both sliding fitment of said elongate distributor within said tubular body and sealing attachment of said cap to one of said open ends of said tubular body.

7. The tubular burner according to claim 1 wherein the elongate distributor includes a cap to which is welded a hemi-cylindrical elongate section having a longitudinal axis substantially coincident with the longitudinal axis of the tubular body, said hemi-cylindrical elongate section being positioned so that its zenith is opposed to an axially parallel line bisecting the flame strip, and an imperforate tubular member secured within the hemi-cylindrical elongate section having a first end coincident with a free end of the hemi-cylindrical elongate section and a second end opening part way along said hemi-cylindrical elongate section.

8. The tubular burner according to claim 7 wherein the hemi-cylindrical elongate section is welded to the cap and wherein said cap is sealingly secured to said tubular body.

9. A distributor for sliding insertion within a tubular burner body, said distributor having all axial length in common with all axial length of the tubular burner body and being of smaller cross-sectional dimension than said tubular burner body to enable sliding fitment of said distributor therein, said distributor including a first imperforate tubular member and an extension portion, said extension portion having a main body of hemi-cylindrical cross section that accommodates said imperforate tubular member and having a radially extending flange extending from opposite longitudinally extending edges of said main body, each of said flanges having a plurality of perforations formed therein, said extension portion being effectively a continuation of an upper surface of said imperforate tubular member and said flanges effectively forming a part of said imperforate tubular member.

* * * * *